US006283297B1

(12) United States Patent
Mosley

(10) Patent No.: US 6,283,297 B1
(45) Date of Patent: Sep. 4, 2001

(54) METHOD AND APPARATUS FOR ORGANIZING THREADS

(76) Inventor: Marie E. Mosley, 3553 Nexus Ct., Woodbridge, VA (US) 22192

( * ) Notice: Subject to any disclaimer, the term of this patent is extended or adjusted under 35 U.S.C. 154(b) by 0 days.

(21) Appl. No.: 09/553,575

(22) Filed: Apr. 20, 2000

(51) Int. Cl.[7] ..... B65D 69/00

(52) U.S. Cl. ..... 206/575; 206/425; 206/388; 206/49

(58) Field of Search ..... 206/48, 388, 425, 206/556, 574, 575, 579, 730, 732, 748, 747; 211/51

(56) References Cited

U.S. PATENT DOCUMENTS

| | | | | |
|---|---|---|---|---|
| D. 255,289 | | 6/1980 | Eubanks et al. . | |
| D. 265,863 | | 8/1982 | McCarn . | |
| D. 273,532 | | 4/1984 | Autry . | |
| D. 322,161 | | 12/1991 | Dalbo et al. . | |
| 1,273,894 | * | 7/1918 | Madison | 206/49 |
| 4,111,341 | * | 9/1978 | Carrozo | 206/574 |
| 4,161,075 | | 7/1979 | Eubanks et al. . | |
| 4,288,010 | | 9/1981 | Holladay . | |
| 4,380,296 | | 4/1983 | Murray et al. . | |
| 4,700,833 | | 10/1987 | Smith . | |
| 4,838,436 | * | 6/1989 | Bailey | 211/51 |
| 4,978,008 | | 12/1990 | Dalbo et al. . | |
| 4,992,050 | * | 2/1991 | Edwards | 206/575 |
| 5,150,794 | * | 9/1992 | Rooks | 206/388 |
| 5,169,041 | | 12/1992 | Tan . | |
| 5,184,729 | * | 2/1993 | Zalenski | 206/574 |
| 5,259,631 | * | 11/1993 | Brande | 229/121 |
| 5,385,237 | | 1/1995 | Mathews . | |
| 5,464,280 | * | 11/1995 | Runger | 312/249.11 |
| 6,032,798 | * | 3/2000 | Bryant | 206/388 |

FOREIGN PATENT DOCUMENTS 398351 9/1933 (GB) .

* cited by examiner

*Primary Examiner*—David T. Fidei
(74) *Attorney, Agent, or Firm*—Richard C. Litman

(57) ABSTRACT

A system for organizing threads for cross-stitching. The system includes a plurality of sheets having a predetermined thickness and a specific absorption characteristic are processed to create a plurality of I-shaped elements as perforated or removable thread retainers. Each retainer is manufactured with indicia to indicate a particular color scheme. This indicia can be produced in a number of different languages for use by a broad spectrum of cross-stitching enthusiasts. The system includes the steps of arranging threads according to at least one predetermined color scheme for cross-stitching; prefabricating a plurality of sheets, having at least one perforated I-shaped element disposed therein; selecting a thread from a variety of threads; wounding the selected thread around the I-shaped element; and inserting the I-shaped element within a multi-level compartment for subsequent use. A color comparison chart is used to compare thread colors.

17 Claims, 5 Drawing Sheets

METHOD AND APPARATUS FOR ORGANIZING THREADS

BACKGROUND OF THE INVENTION

1. Field of the Invention

The present invention relates generally to sewing accessories. More specifically, the invention is a method and apparatus or system for organizing a plurality of threads according to various color schemes for cross-stitching.

2. Description of the Related Art

A number of methods and/or devices have been devised which attempt to minimize or completely alleviate labor intensive chores associated with the sewing arts or cross-stitching. In most instances, novice and professional practitioners in the knitting, sewing and/or cross-stitching arts find it difficult and quite cumbersome to quickly and efficiently deploy and use conventional devices for the respective methods especially within relatively small work-spaces. This is due primarily to the many challenges that a user faces such as having to keep balls of various threads, yarn, etc. and other accessories neatly confined in one location during use without the fear of a complete disaster when one is interrupted via a phone call or other emergency, and is forced to leave a settled work space.

Other challenges, include preparation or time consuming tasks such as having to manually label numerous thread holders for a project just to identify certain colors when pre-packaging material has been removed. Thread suppliers such as DMC, Anchor, and others have attempted to minimize color identification problems by identifying colors of threads in particular by color coded schemes. While this has helped those who may suffer minor or severe color distinguishing problems, there is no adequate technique which simplifies organization within a specific work space or domain. A method and apparatus or system which virtually alleviates the aforementioned problems associated with conventional techniques, and makes the task of cross-stitching a labor of love with reduced time in preparatory labor is needed.

For example, U.S. Pat. No. 4,161,075 issued to Eubanks et al. discloses a thread and yarn organizer comprising a flat hourglass shaped holder around which, yarn may be wound, and having slits at one end for retaining the ends of the yarn. A tongue member having substantially parallel sides and a curved free end is used to insertably retain a label member having disposed thereon handprinted indicia.

U.S. Pat. No. 4,288,010 issued to Holladay discloses an embroidery thread organizer comprising a nested set of cylindrical tubes, each having a number of spaced outwardly projecting annular divider members or ribs which define segregated spool portions for securing windings of thread thereto. The nested tubes are made of clear plastic to enable a user to see the color of threads available. An outer tubular plastic case is also included to house the nested cylinders in a stored configuration.

U.S. Pat. No. 4,380,296 discloses a yarn holder and method of separating yarn by color comprising a circular, transparent, plastic disc having a plurality of circular holes located equidistant from the center of the disc and being substantially equidistant from each other on a first peripheral portion of the disc. Along a second peripheral portion, radially outward from the first peripheral portion of the disc is a plurality of radial tabs equal in number to the number of holes in direct alignment. The disc is supported by a three pronged stand secured thereto and to a circular base via screw type fasteners. A plurality of threads are wrapped around a single tab with the free ends inserted through an adjacent circular hole for hanging.

Similar thread hanging organizers are disclosed in U.S. Patents issued to Dalbo et al. (4,978,008) and Mathews (5,385,237). The organizer taught by Dalbo et al. (as similarly taught by the British Patent granted to Mayne et al.) is a flat card member having a plurality of spaced apart holes disposed adjacent to the edge portions of the card for insertably looping and hanging a plurality of threads. The organizer taught by Mathews utilizes a plurality of linearly disposed ring members on a loose leaf type back support in which to hang individual threads.

U.S. Pat. No. 4,700,833 issued to Smith discloses a suture winding card comprising a base panel and a plurality of flaps extending from and foldable over the base panel to cover and secure a suture thread coil disposed thereon. One of the flaps includes a plurality of triangular shaped flaps which are selectively folded to form a pocket for receiving the end of a suture needle.

U.S. Pat. No. 5,169,041 issued to Tan discloses a portable sewing kit comprising an elongated housing for holding a needle with a point at one end and an eyelet at the other end. A spool section is integrally connected to the housing and extends away from the housing as narrow neck portion. This section has a width which is smallest at the end connected to the housing and increases to reach a maximum at the end furthest from the housing.

U.S. Design patents issued to Eubanks et al. (255,289), McCarn (265,863), Autry (273,532) and Dalbo et al. (322,161) are of general relevance to the method and apparatus for organizing threads as herein described.

None of the above inventions and patents, taken either singularly or in combination, is seen to describe the instant invention as claimed. Thus, the method and apparatus for organizing threads solving the aforementioned problems is desired.

SUMMARY OF THE INVENTION

The method and apparatus according to the invention is a system for organizing a variety of threads and accessories for cross-stitching. The method includes wherein a plurality of sheets having a predetermined thickness are processed to create a plurality of I-shaped elements as perforated or removable thread retainers. Each retainer is manufacture with indicia to indicate a particular color scheme. This indicia can be produced in a number of different foreign languages for use by a broad spectrum of cross-stitching enthusiasts. The method includes the general steps of arranging a predetermined number of threads according to at least one predetermined color scheme for cross-stitching; prefabricating a plurality of sheets having a predetermined thickness with at least one perforated I-shaped element disposed therein; selecting a thread from a variety of threads based on the predetermined color scheme; wounding the selected thread around the I-shaped element; inserting the wounded I-shaped element within a distinct spring loaded compartment, disposed within a first level of a multi-level storage compartment; comparing a single wounded element to another threaded element having a comparable color characteristic according to another color scheme or manufacturer; and storing residual threads from the arranged predetermined number of threads in a second level of the multi-level storage compartment for transport or subsequent deployment.

A practitioner selects a single I-shaped element from the plurality of pre-fabricated sheets having selective indicia which indicates at least one color from the predetermined color scheme and an associative number of at least one color from the respective color scheme. Various threads are selected from a variety of prepackaged thread sets such as those produced by DMC, Anchor and others based on a color scheme of a particular cross-stitching patterned color scheme. Each thread or a comparative thread is matched with a prefabricated I-shaped element having indicia corresponding to a color and an associative number code of a particular manufacturer (i.e. DMC, Anchor, etc.).

The selected thread is wounded about the element for storage or subsequent use for a particular cross-stitching project. As implied, if a particular color of thread is not provided by one of the manufacturers recited above for a specific project, the method includes the step of comparing a wounded element of a specific color or manufacturer (known or unknown) which is matched with a comparative color coded thread of another manufacturer via a comparison chart or register. These steps are continued in sequence until all of the predetermined number of threads have been organized.

The multilevel storage compartment or facility has a top and plurality of compartments for accommodating a number of I-shaped threaded retainer which include a distinct spring loaded mechanism disposed therein at a first compartment level. A second storage compartment level retains cross-stitching accessories, and a third storage compartment level which retains cross-stitch fabric patterns and needles. Each respective compartment is secured in a stacked configuration as vertically insertable compartments. Simple male and female releasable fasteners provide for simple connections between each respective compartment as a portable carrying multilevel storage compartment. The system is simple to use, easy to deploy for greater ease and organization.

Accordingly, it is a principal object of the invention to provide a method and apparatus or system for organizing threads for cross-stitching.

It is another object of the invention to provide a method and apparatus for organizing threads for cross-stitching which simple to use and easy to deploy.

It is a further object of the invention to a method and apparatus for organizing threads for cross-stitching which virtually minimizes preparatory labor for deployment and removal from location to location.

Still another object of the invention is to provide a system having material elements which are light-weight, durable and impervious to moisture laden effects such as rust and corrosion It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a method and apparatus or system of organizing a variety of threads for cross-stitching. The preferred embodiment(s) of the present invention are depicted in FIGS. 1–4, and is generally referenced by numeral 5.

Figure 1:
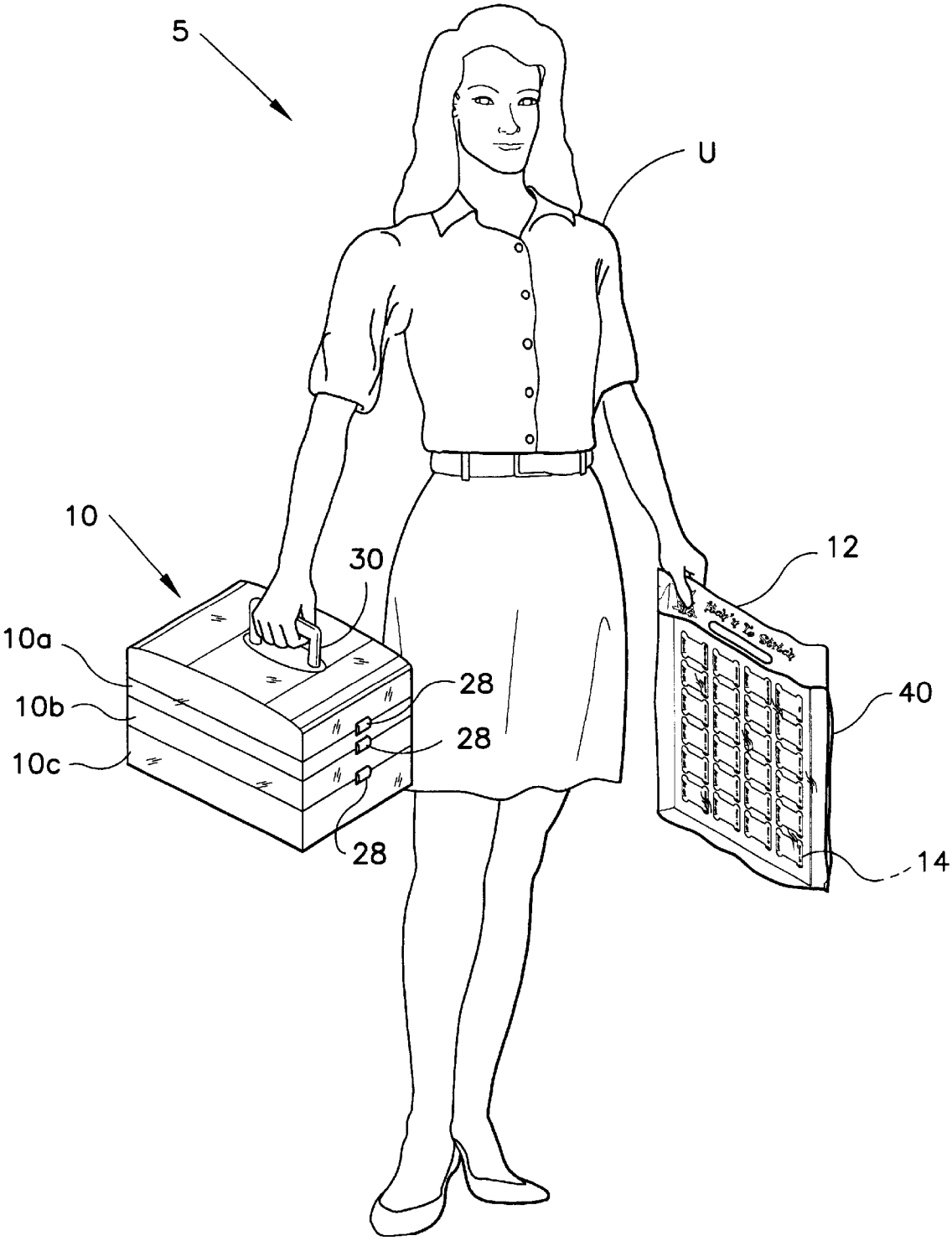
FIG. 1 is an environmental, perspective view of a method and apparatus or system of organizing threads for cross-stitching according to the present invention.
Figure 2A:
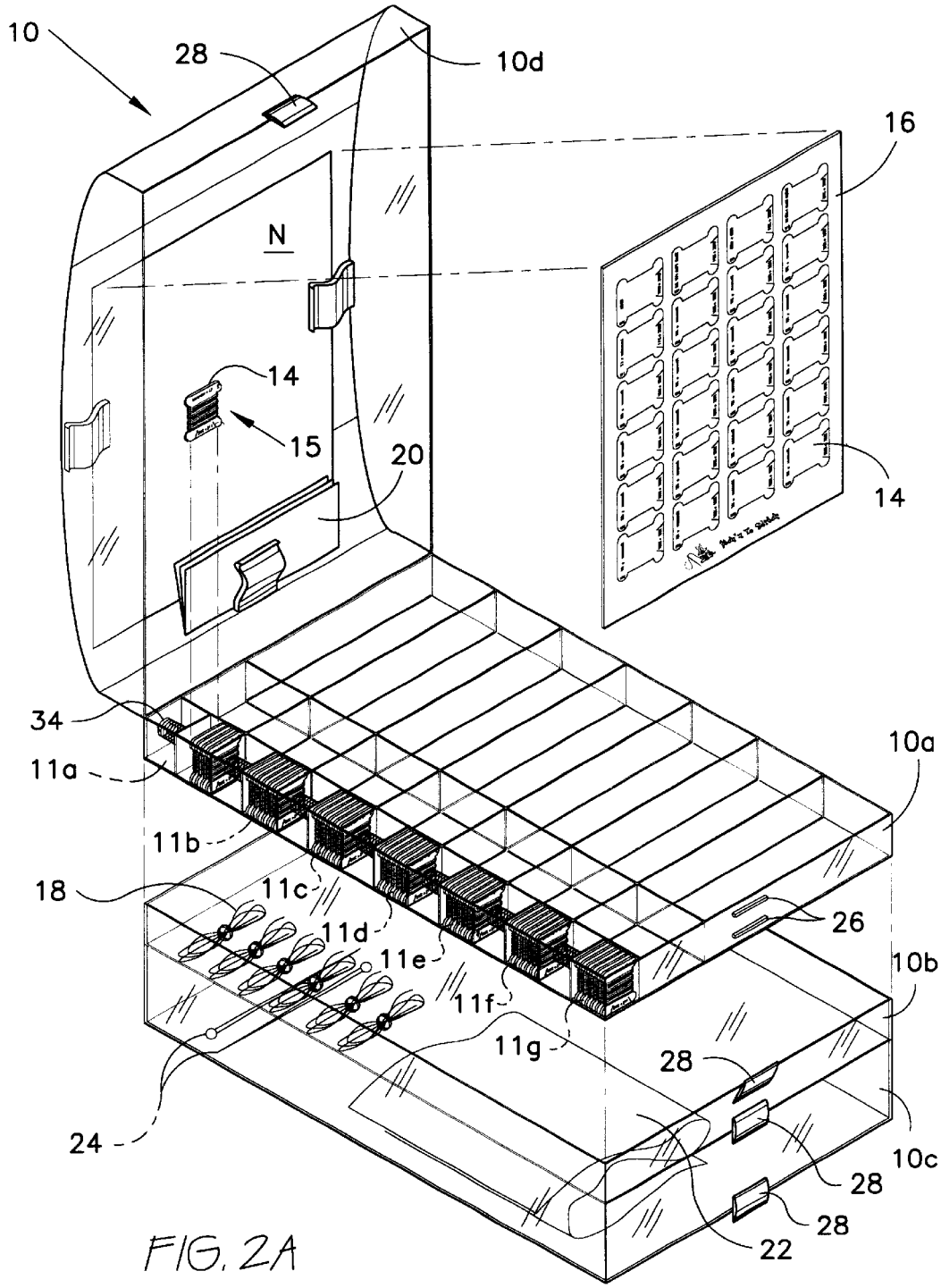
FIG. 2A is an exploded perspective view of the apparatus and system of organizing threads according to the invention.

As diagrammatically illustrated in FIGS. 1 and 2A, the system 5 is shown being transported by a practitioner or user U in component parts 10 and 12. As will be more clearly defined hereinbelow, a practitioner U selects a single I-shaped element 14 from a plurality N (where N=1, 2, 3 to the number of sheets required to depict at least one manufacturer's color scheme) of pre-fabricated sheets 16 having selective indicia 17 disposed thereon to indicate at least one color of a thread from a predetermined color scheme provided by various manufacturers or companies (eg. DMC, Anchor, J & P Coats, Ginnie Thompson Flower Thread (GTFT), Semco and Madeira (MAD)).

The color code indicia scheme used denote the color of various threads 18 according to the invention is consistent with these manufactures in that each I-shaped element 14 includes an associative number 17*a* indicative of at least one color indicia 17*b* according to the respective manufacturer's color scheme 17*c*. The practitioner which utilizes this system would find that valuable time can be conserved without the step of having to manually indicate an array of colors in accordance with a particular manufacturer's color scheme for threads 18.

Accordingly, various threads are selected from a variety of pre-packaged thread sets (not shown) and are organized in the instant invention according to the following method steps: (a) arranging a predetermined number of threads 18 according to at least one predetermined color scheme 17*c* for cross-stitching; (b1) prefabricating a plurality of sheets 16 having a predetermined thickness and an absorption characteristic (which reduces moisture and stains) with at least one perforated I-shaped element 14 disposed therein, the at least one perforated element 14 having selective indicia 17*a*, 171*b* and 17*c* disposed thereon to reflect a color scheme (for a plurality of colors) for each of the plurality of sheets 16; (b2) selecting a single I-shaped element 14 from the plurality of pre-fabricated sheets 16 having the selective indicia indicating at least one color such as Lavender (LT), 211 or Red 323 of the DMC designation from the predetermined color scheme including an associative number of a respective color;

(c) selecting a thread 18 from a variety of threads based on the predetermined color scheme 17*c* of step (a) and corresponding to the element 14 according to the selecting step (b), this selecting step can also include the step of anchoring the selected threads 18 to at least one anchoring slit 7*d* disposed within the base of the element 14 along a diagonal;

(d) wounding the selected thread 18 of step (c) around the I-shaped element 14;

(e) inserting the wounded I-shaped element 15 of step (d) within a distinct spring loaded compartment 11*a*, 11*b*,

11*c*, 11*d*, 11*e*, 11*f*, 11*g* disposed within a first level of a multi-level storage compartment 10 in a linear fashion (as depicted in FIG. 2A) as a color coordinated storage compartment depending on a specific cross-stitching project;

(f) comparing the single wounded element 15 of step (d) with another threaded element according to another color scheme (such as Anchor (ANCH)) via a comparison chart or storage register 20. This register utilizes the DMC™ and ANCH™ color scheme for selecting comparative colors of threads 18, but is not limited thereto. Each selected thread 18 is so organized from steps (a) through (e) in respective sequence until the predetermined number of threads 18 have been organized and stored according to at least one predetermined color scheme or a comparative color scheme for subsequent deployment. The method of the system 5 further comprises the step of (h) storing residual threads 18 from the arranged predetermined number of threads in a second level of the multi-level storage compartment 10*b*.

In a stored configuration, the system 5, is provided as a kit comprising element 10 and 12 available with indicia of various foreign languages for global use by a broad range of practitioners. In this configuration, as diagrammatically illustrated in FIGS. 2A and 3, elements 10 and 12, respectively are packaged as a single integrated unit for deployment. Each thread or a comparative thread 18 is matched with a prefabricated I-shaped element 14 having indicia corresponding to a color 17*b* and an associative number code 17*c* of a particular manufacturer as recited above (i.e. DMC™, Anchor™, etc.). The selected thread 18 is wounded about the element for storage or subsequent use for a particular cross-stitching project. As implied above, if a particular color of thread is not provided by one of the manufacturers recited above the method includes the step of comparing a wounded element 15 of a specific color or manufacturer (known or unknown) which is matched with a comparative color coded thread of another manufacturer via a comparison chart or register 20. These method steps are continued in sequence until all of the predetermined number of threads have been organized.

Figure 2B:
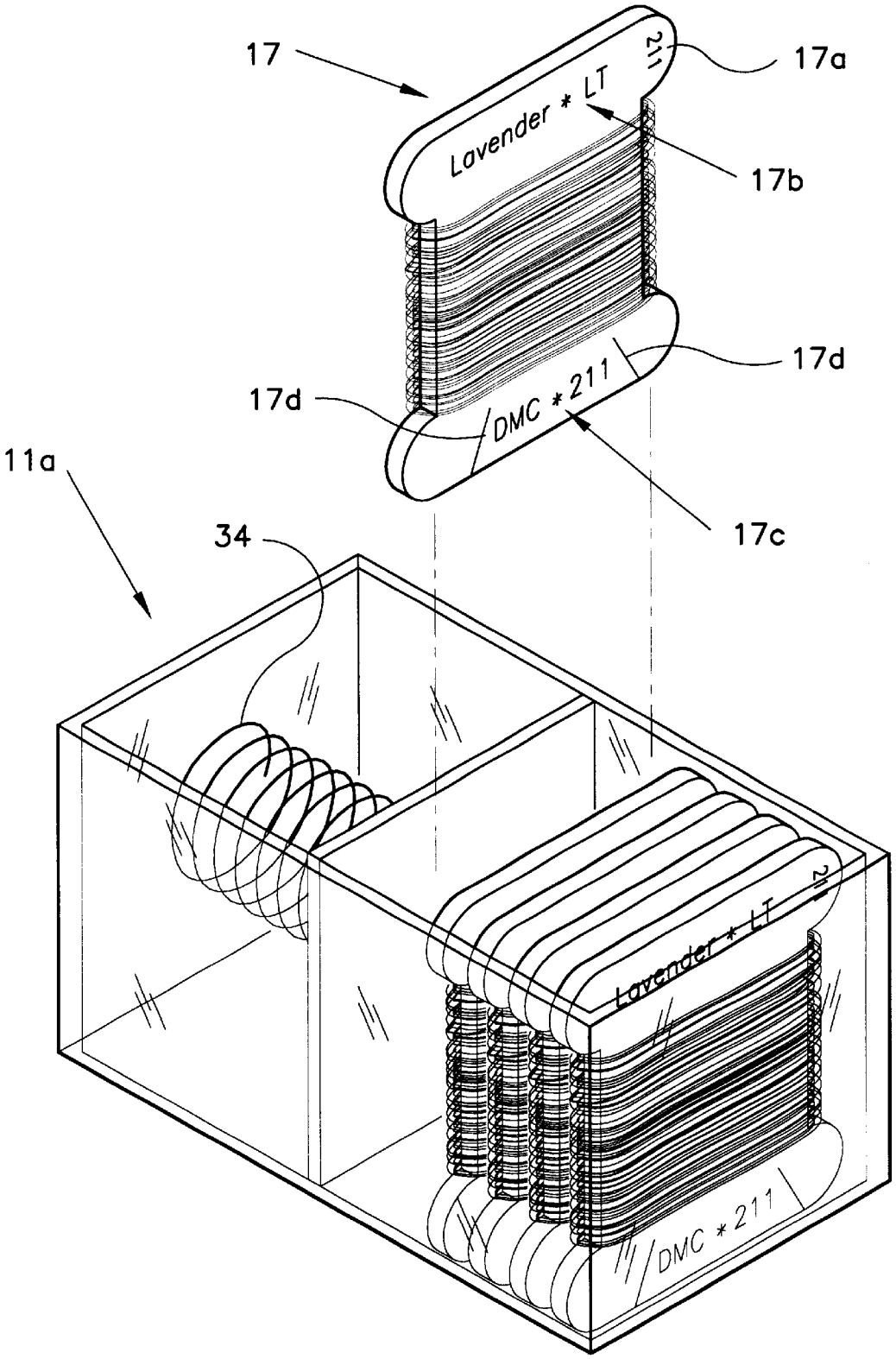
FIG. 2B is a perspective view of a single compartment for organizing threads according to the invention, illustrating a spring-loaded thread displacement mechanism.
Figure 3:
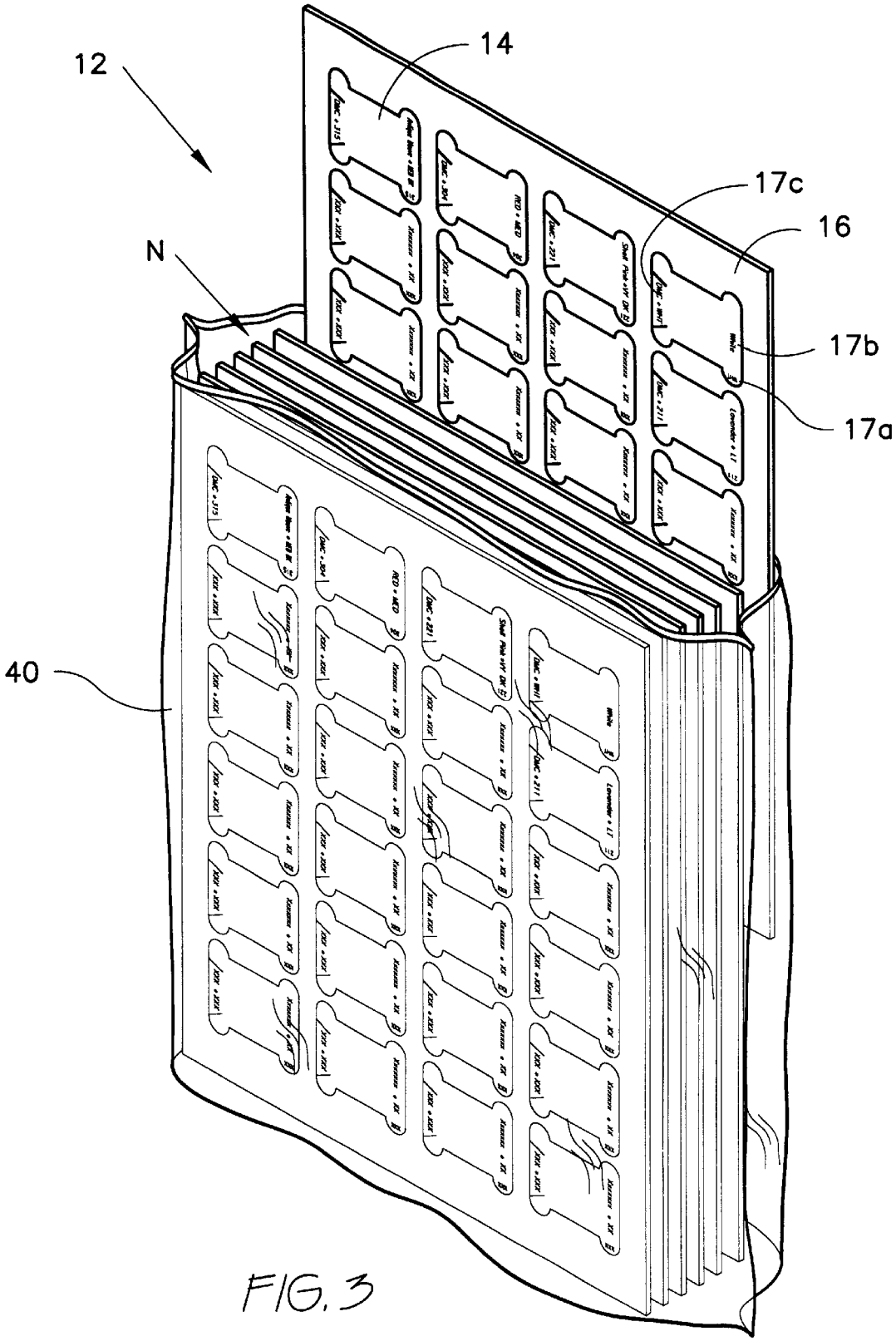
FIG. 3 is a partial view of the system in the form of a kit, illustrating a prefabricated unthreaded holders with selective indicia of a particular color scheme.
Figure 4:
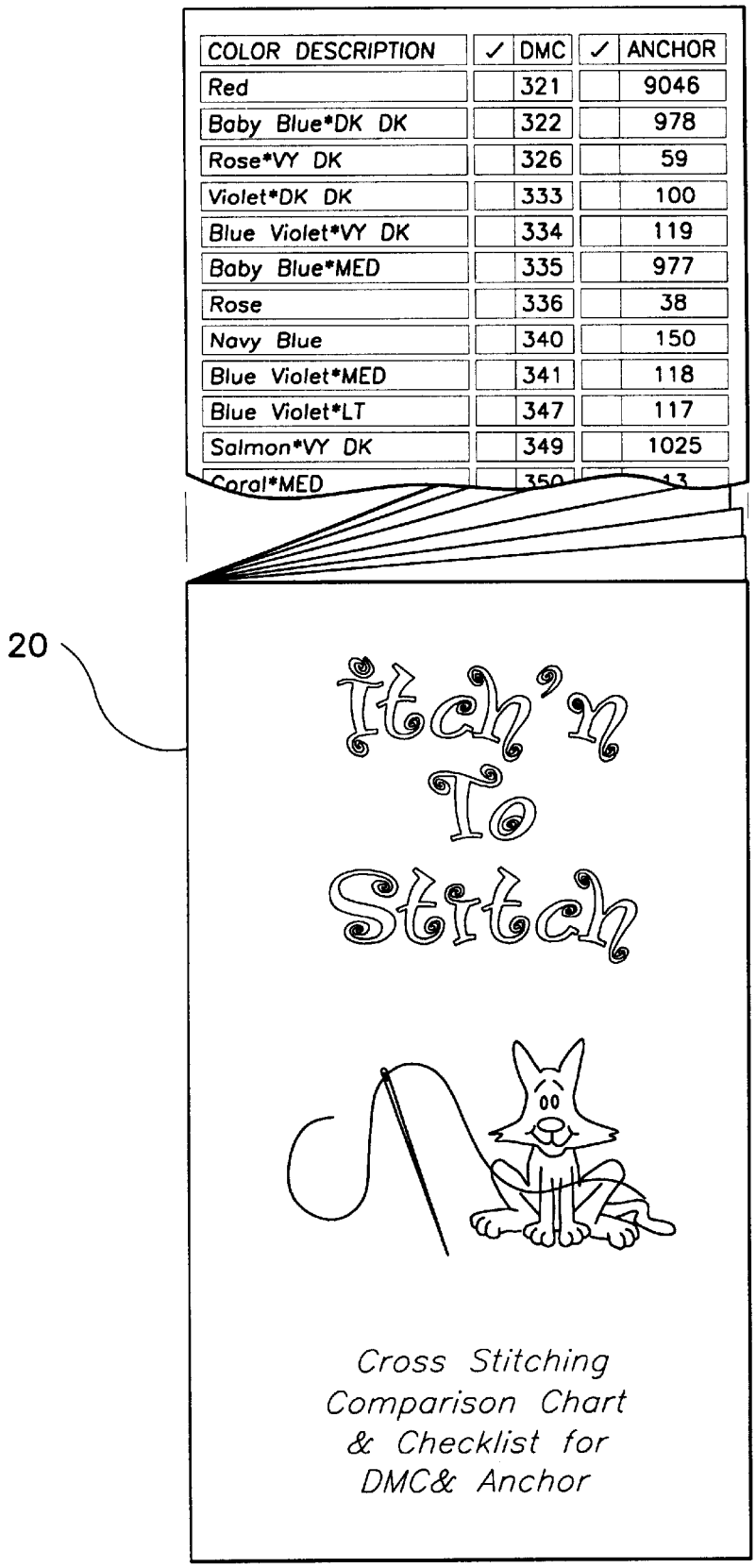
FIG. 4 is a perspective view of a color scheme comparison register or storage medium for a variety of different and/or similar color threads according to the invention.

With more particularity, the system or kit 5 for organizing a variety of threads for cross-stitching as diagrammatically illustrated in FIG. 2, includes a multilevel cross-stitching storage compartment 10, having a top 10*d*, a first storage compartment level 10*a* for insertably storing at least one wounded I-shaped threaded retainer element 15, a second storage compartment level 10*b* for retaining cross-stitching accessories (such as threads, etc.), and a third storage compartment level 10*c* for retaining cross-stitch fabric patterns 22 and needles 24. The the first 10*a*, second 10*b* and third compartment 10*c* levels are interconnected and secured to each adjacent compartment in an insertable and stacked configuration via releasable male 26 and female 28 fastener means. These mechanical fasteners are integrally formed within the container 10 via a injection mode process.

The top 10*d* further comprises an end hingedly connected to a wall portion of the first compartment level 10*a* as a living hinge. A substantially C-shaped handle 30 is attached to an outer surface of the top 10*d* centrally disposed thereto. Within an interior surface portion of the top 10*d*, at least one attachment means 32 is disposed thereon for insertably attaching a plurality of objects such as the plurality of sheets 16 and the comparison chart or register 20 thereto. It is preferred that the volume of the first compartment level 10*a* be less than the volume of the second compartment level 10*b*. With respect to the third compartment level 10*c* it is preferred that its volume be greater than either of first and second compartments. This particular configuration not minimizes unnecessary storage as intended herein with minimum material and cost requirements for manufacturing. In this regard, the multi-level compartment 10 is interconnected as a single integrated carrying storage compartment.

The apparatus or multilevel storage compartment 10 for organizing a variety of threads according to the invention includes a plurality of sub-compartments 11*a*–11*g* having a spring loaded mechanism 34 for retaining at least one threaded I-shaped element 15. Each spring is set having a diameter and spring constant k (Newtons/ meter (N/m)) sufficient to retain a plurality of such threaded elements 15 in a stored configuration (FIG. 2A) without removal during transport. The first compartment level comprises another plurality of sub-compartments 36 having a larger volume capacity than the first plurality of spring-loaded compartments for retaining unthreaded I-shaped elements 14 and elective threads 18. The apparatus for organizing a variety of threads according to is made of a durable plastic material. This material can be either transparent or opaque depending on the intended or environment of use.

In addition, it is preferred that the multi-level compartment 10 be made by an injection molded process with the advantages of minimize material and cost requirements. Other advantages of the system 5 include wherein the system 5 is available as a kit having a plurality of sheets 16 of predetermined thickness. Each of the sheets 16 including a plurality of perforated I-shaped elements 14 having prefabricated selective indicia 17*a* and 17*b* disposed on a surface portion of the elements 14 for depicting various colors according to a preselected color scheme 17*c*; a storage means or register 20 for storing a plurality of indexed color codes of threads 18 according to at least one specific color scheme, and for comparing the threads 18 with another one of the at least one color schemes; and a multi-level storage compartment 10 having the characteristics and features as recited above. To reduce the effects of moisture and staining, it is preferred that the plurality of prefabricated sheets 18 with indicia disposed thereon in various languages include a prepackaging material covering 40 made of a composite material such as plastic, nylon or paper or a combination thereof. It is acknowledged where appropriate that the producer of various colors of threads (i.e. DMC, Anchor(ANCH), J & P Coats, Ginnie Thompson Flower Thread (GTFT), Semco and Madeira (MAD)) are registered trademarks and no claim is directed thereto.

It is to be understood that the present invention is not limited to the embodiments described above, but encompasses any and all embodiments within the scope of the following claims.

I claim:

1. An apparatus for organizing a variety of threads for cross-stitching, comprising:

a multi-level cross-stitching storage compartment, said compartment having a top, a first storage compartment level for insertably storing at least one wounded I-shaped threaded retainer element, a second storage compartment level for retaining cross-stitching accessories, and a third storage compartment level for retaining cross-stitch fabric patterns and needles;

the first, second and third compartment levels are interconnected and secured to each adjacent compartment in an insertable and stacked configuration via releasable mechanical fasteners;

said top further comprises an end hingedly connected to a wall portion of the first compartment level, a handle, a fastener means for connecting to an opposing wall portion of said hingedly connected end of said first compartment level, and at least one attachment means for insertably attaching a plurality of objects thereto, and wherein the volume of the first compartment level is less than the volume of the second compartment level, and said third compartment level has a volume greater than either said first and second compartments, the multi-level compartment is interconnected as a single integrated carrying storage compartment.

2. The apparatus for organizing a variety of threads according to claim 1, wherein said first compartment level comprises a plurality of sub-compartments having a spring loaded mechanism for retaining at least one threaded I-shaped element.

3. The apparatus for organizing a variety of threads according to claim 2, wherein said first compartment level comprises another plurality of sub-compartments having a larger volume capacity than the first plurality of spring-loaded compartments for retaining unthreaded I-shaped elements and threads.

4. The apparatus for organizing a variety of threads according to claim 1, wherein said multi-level compartment is made of a durable plastic material.

5. The apparatus for organizing a variety of threads according to claim 1, wherein said multi-level compartment is made from an injection molded process.

6. A kit for organizing a variety of threads for cross-stitching, comprising:

a plurality of sheets of predetermined thickness, said sheets include a plurality of perforated I-shaped elements having prefabricated selective indicia disposed on a surface portion of said elements for depicting various colors according to a preselected color scheme;

a storage means for storing a plurality of indexed color codes of threads according to at least one specific color scheme, and for comparing said threads with another one of said at least one color scheme; and a multi-level storage compartment having a handle and at least one insertable fastener means for insertably and releasably retaining said plurality of sheets of predetermined thickness and said storage means therein.

7. The kit for organizing a variety of threads according to claim 6, wherein said multi-level storage compartment comprises, a top, a first storage compartment level for insertably storing at least one wounded I-shaped threaded retainer element, a second storage compartment level for retaining cross-stitching accessories, and a third storage compartment level for retaining cross-stitch fabric patterns and needles;

the first, second and third compartment levels are interconnected and secured to each adjacent compartment in an insertable and stacked configuration via releasable mechanical fasteners;

said top further comprises an end hingedly connected to a wall portion of the first compartment level, a fastener means for connecting to an opposing wall portion of said hingedly connected end of said first compartment level, and at least one attachment means for insertably attaching a plurality of objects thereto.

8. The kit for organizing a variety of threads according to claim 6, wherein the volume of the first compartment level is less than the volume of the second compartment level, and said third compartment level has a volume greater than either said first and second compartments, the multi-level compartment is interconnected as a single integrated carrying storage compartment.

9. The kit for organizing a variety of threads according to claim 6, wherein said first compartment level comprises a plurality of sub-compartments having a spring loaded mechanism for retaining at least one threaded I-shaped element.

10. The kit for organizing a variety of threads according to claim 9, wherein said first compartment level comprises another plurality of sub-compartments having a larger volume capacity than the first plurality of spring-loaded compartments for retaining unthreaded I-shaped elements and threads.

11. The kit for organizing a variety of threads according to claim 6, wherein said multi-level compartment is made of a durable plastic material.

12. The kit for organizing a variety of threads according to claim 6, wherein said plurality of perforated I-shaped elements include color scheme indicia in a distinct foreign language.

13. The kit for organizing a variety of threads according to claim 6, wherein said plurality of sheets further comprises a protective covering for preventing moisture related damage.

14. The kit for organizing a variety of threads according to claim 13, wherein said covering is made of a composite material.

15. The kit for organizing a variety of threads according to claim 13, wherein said covering is made of a transparent composite material.

16. The kit for organizing a variety of threads according to claim 14, wherein said composite material is one of plastic, nylon or paper.

17. The kit for organizing a variety of threads according to claim 14, wherein said handle is substantially C-shaped and is disposed on a top surface of said compartment for gripping.

* * * * *